US005330416A

United States Patent [19]

Masuda et al.

[11] Patent Number: 5,330,416

[45] Date of Patent: Jul. 19, 1994

[54] ROLLING MASSAGE APPARATUS WITH VIBRATORY SUPPORT

[75] Inventors: Teruo Masuda, Tokyo; Masahiro Matsuzaki, Sayama; Shoji Ohshita, Saitama, all of Japan

[73] Assignee: France Bed Co., Ltd., Tokyo, Japan

[21] Appl. No.: 885,510

[22] Filed: May 19, 1992

[30] Foreign Application Priority Data

May 28, 1991 [JP] Japan ..... 3-37669[U]
Dec. 13, 1991 [JP] Japan ..... 3-330466

[51] Int. Cl.[5] ..... A61H 15/00
[52] U.S. Cl. ..... 601/52; 601/99
[58] Field of Search ..... 128/57, 33, 58, 52, 128/51, 36, 32; 5/108, 109, 933, 934

[56] References Cited

U.S. PATENT DOCUMENTS

| | | | |
|---|---|---|---|
| 3,039,458 | 6/1962 | Hill | 128/52 |
| 3,322,116 | 5/1967 | Murphy | 128/33 |
| 3,389,699 | 4/1968 | Mathers | 128/33 |
| 3,736,920 | 6/1973 | Mathers | 128/33 |
| 4,586,493 | 5/1986 | Goodman | 128/57 |
| 4,656,998 | 4/1987 | Masuda et al. . | |
| 4,662,362 | 5/1987 | Masuda | 128/33 |
| 5,094,225 | 3/1992 | Craw | 128/57 |

FOREIGN PATENT DOCUMENTS

| | | | |
|---|---|---|---|
| 58858 | 9/1982 | European Pat. Off. | 128/57 |
| 180386 | 3/1992 | Taiwan . | |

*Primary Examiner*—Robert A. Hafer
*Assistant Examiner*—David Kenealy
*Attorney, Agent, or Firm*—Frishauf, Holtz, Goodman & Woodward

[57] ABSTRACT

A carrier holding massage rollers is provided on an upper surface of a base plate so that the carrier can run on the upper surface of the base plate. A vibration transmission plate made of a material capable of transmitting vibration is provided on the base plate. The vibration transmission plate is provided with a vibration generator. Thus, when the vibration generator is actuated, the vibration transmission plate vibrates to massage a person lying on his/her back over the base plate.

16 Claims, 13 Drawing Sheets

ROLLING MASSAGE APPARATUS WITH VIBRATORY SUPPORT

BACKGROUND OF THE INVENTION

1. Field of the Invention

The present invention relates to a mattress-type massage apparatus for massaging a user lying on his/her back.

2. Description of the Related Art

In general, this type of massage apparatus has a base plate, and a carrier is provided on the upper surface of the base plate such that the carrier can run on the base plate. The base plate and carrier are covered with a cloth cover. Massage rollers are rotatably supported on the carrier. The carrier is reciprocally moved along the longitudinal axis of the base plate by a driving mechanism. Thereby, almost the entire length of the back of the user lying on the cover is massaged by the massage rollers.

The mattress-type massage apparatus having the above structure is disclosed, for example, in U.S. Pat. No. 4,656,998. Specifically, a pair of carriers are provided on the base plate at a predetermined interval along the longitudinal axis of the base plate. The carriers are reciprocally driven, and the back of the user is massaged from the parts corresponding to the massage rollers.

If the running speed of the massage rollers is increased, the user feels pain. Thus, in order to give comfortable massage effects on the user, the running speed of the massage rollers cannot be increased excessively.

However, if the running speed of the massage rollers is decreased to such a level that the user does not feel pain, a long time is required until the massage rollers which are reciprocally moved are returned to the initial position. For example, if the massage rollers start to run from the back of the user, a long time is required until the massage rollers move to the waist, buttocks and legs and return to the back. Since the cycle of massaging the same parts of the user increases, the massage effects on the user decrease.

SUMMARY OF THE INVENTION

The object of the present invention is to provide a mattress-type massage apparatus capable of enhancing massage effects on a user, without increasing the running speed of massage rollers.

According to this invention, there is provided a massage apparatus comprising: a flat and long base plate; a carrier holding massage rollers and situated so as to be able to run over an upper surface of the base plate; driving means for reciprocally driving the carrier in the longitudinal direction of the base plate; a vibration transmission plate provided on the base plate and made of a material capable of transmitting vibration; a vibration generator provided on the vibration transmission plate and driven to vibrate the vibration transmission plate; and a cover covering at least an upper surface of the base plate.

According to this massage apparatus, the back of the user lying on his/her back over the cover can be massaged by reciprocally driven massage rollers, and the part of the user's body which is not in contact with the massage rollers can be massaged by vibration generated by the vibration generator via the vibration transmission plate. Therefore, massage effects on the user can be enhanced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will now be described with reference to the accompanying drawings.

FIGS. 1 to 15 show a first embodiment of the invention.

Figure 1:
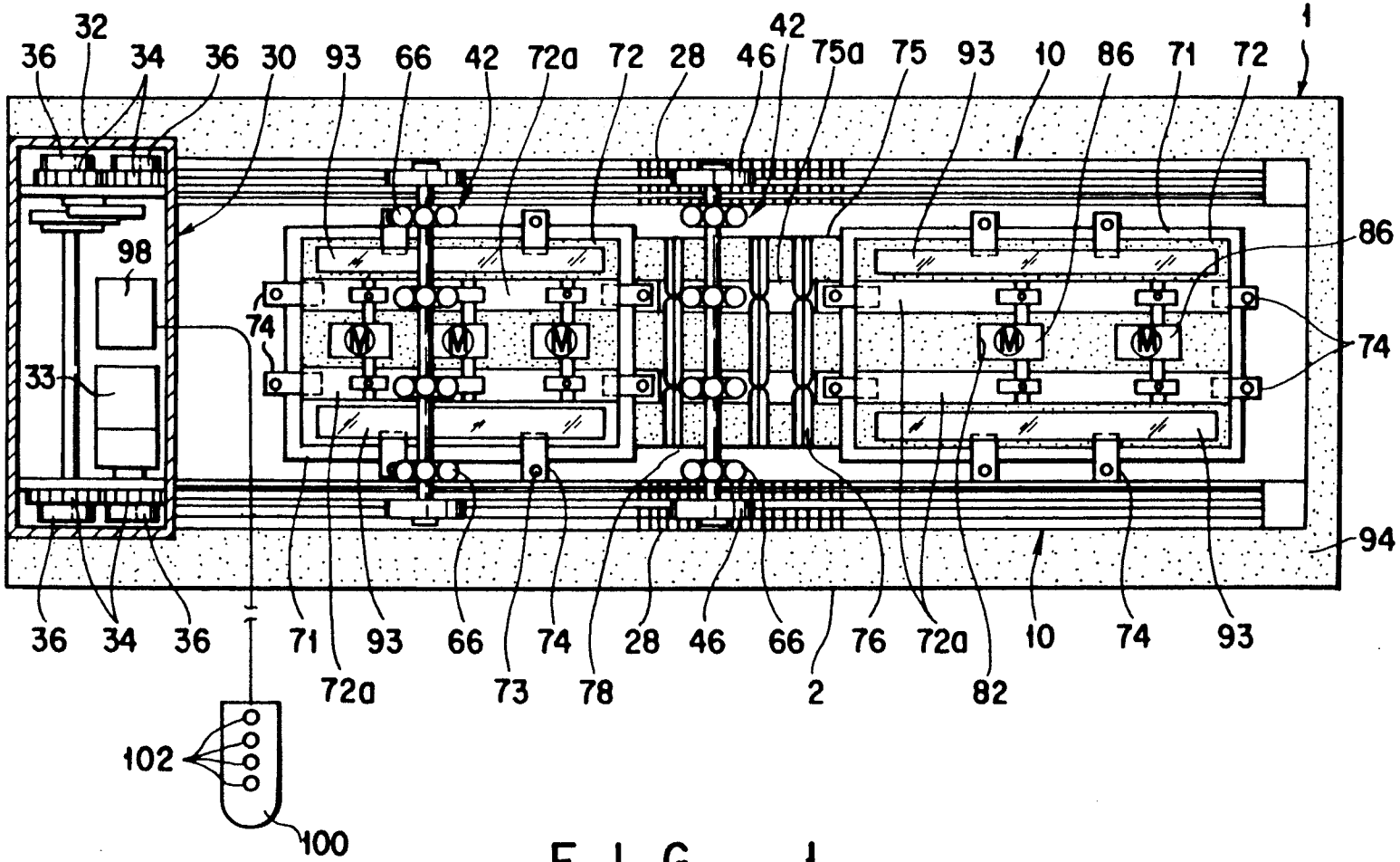
FIG. 1 is a plan view of a base plate showing the entire structure of a first embodiment of the present invention.
Figure 2:
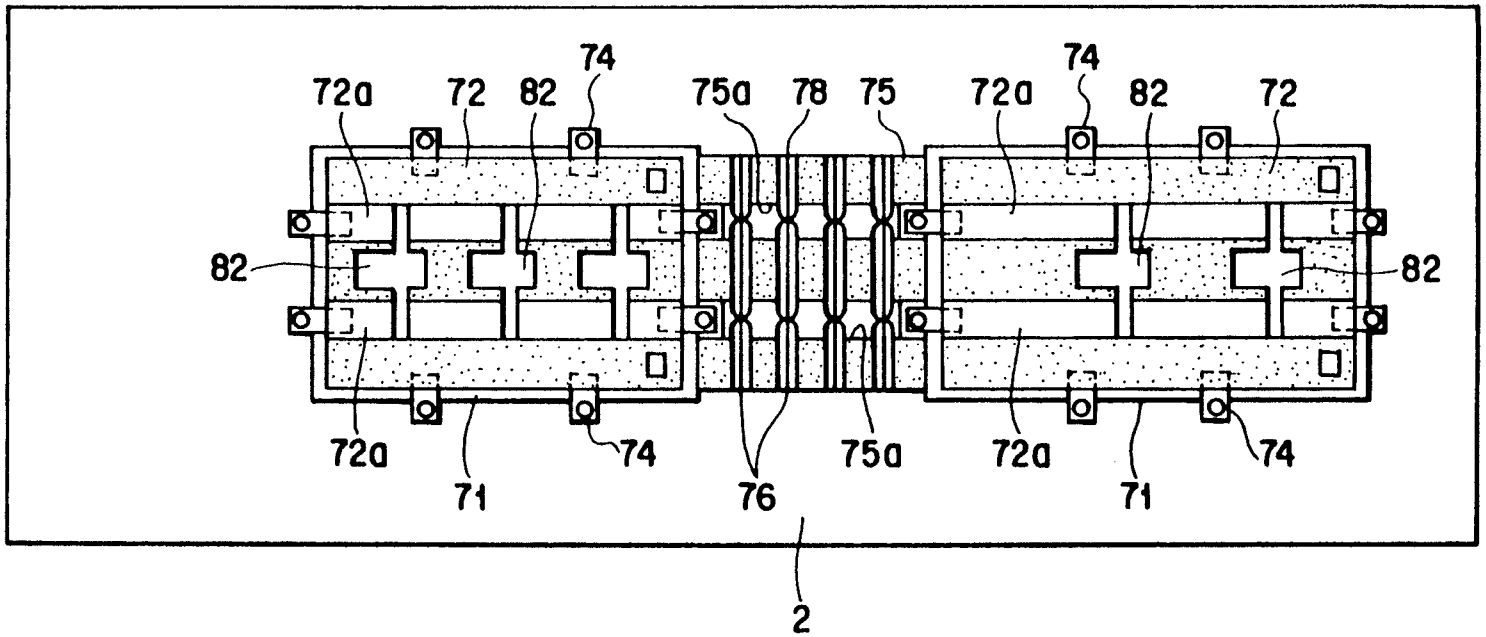
FIG. 2 is a plan view of the base plate according to the first embodiment, from which a driving unit is removed.
Figure 3:
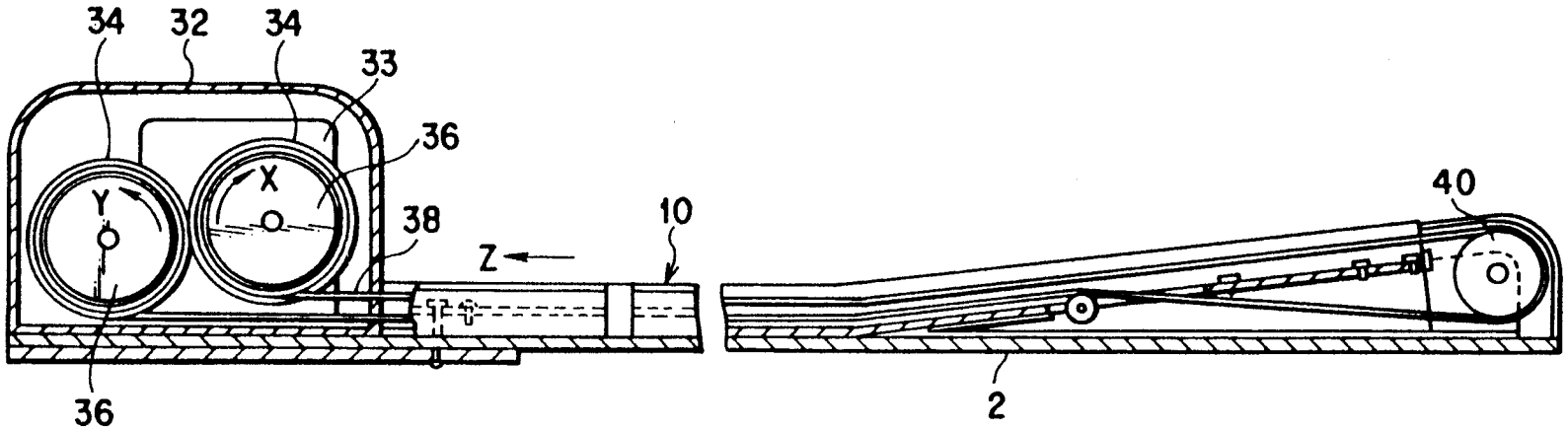
FIG. 3 is a cross-sectional view of the base plate according to the first embodiment, taken along the longitudinal axis of the base plate.
Figure 7:
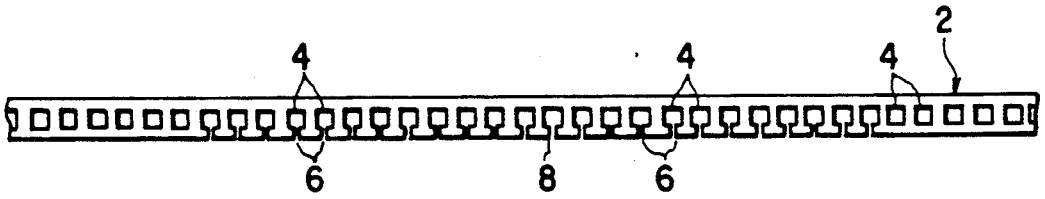
FIG. 7 is a side view of a middle part of the base plate along its longitudinal axis according to the first embodiment.

A massage apparatus 1 shown in FIGS. 1 to 3 has a flat base plate 2. The base plate 2 is made of a synthetic resin such as nylon, polypropylene, polyvinyl or urethane. The base plate 2 includes a number of cavities 4 each having a rectangular cross section and penetrating in the width direction of the base plate 2, as shown in FIG. 7. The cavities 4 are arranged at regular intervals along the longitudinal axis of the base plate 2.

Those cavities 4 which are located at the middle part of the base plate 2 along its longitudinal axis communicate with slits 6. One end of each slit 6 opens to the lower surface of the base plate, and the other end thereof communicates with the corresponding cavity 4. Each slit 6 extends along the entire width of the base plate 2. Accordingly, the base plate 2 can be folded at the longitudinal middle part thereof by means of the cavities 4 and slits 6. Specifically, a first soft portion 8 is formed at the longitudinal middle portion of the base plate 2, thereby enabling the base plate 2 to be folded.

Figure 4:
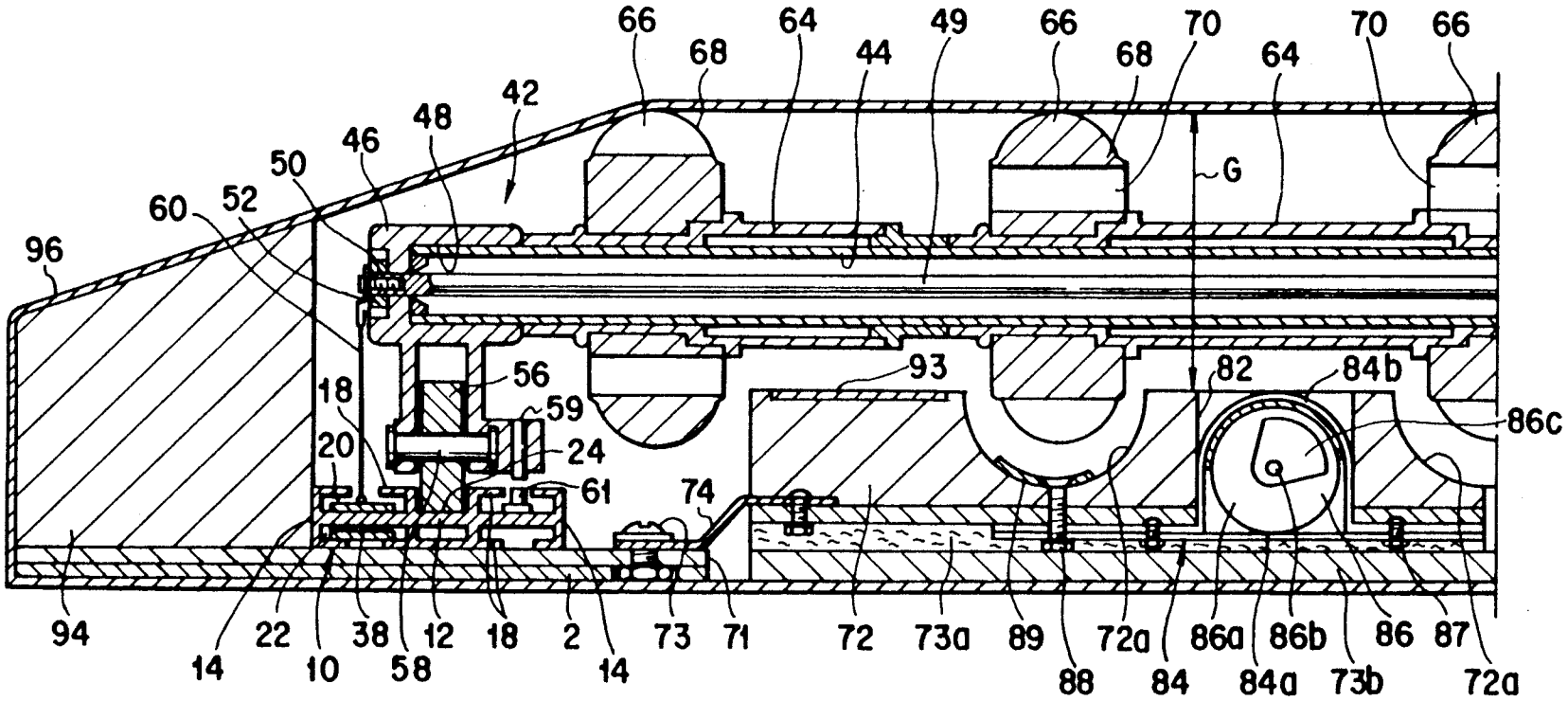
FIG. 4 is a partly enlarged cross-sectional view of a carrier according to the first embodiment.
Figure 5:
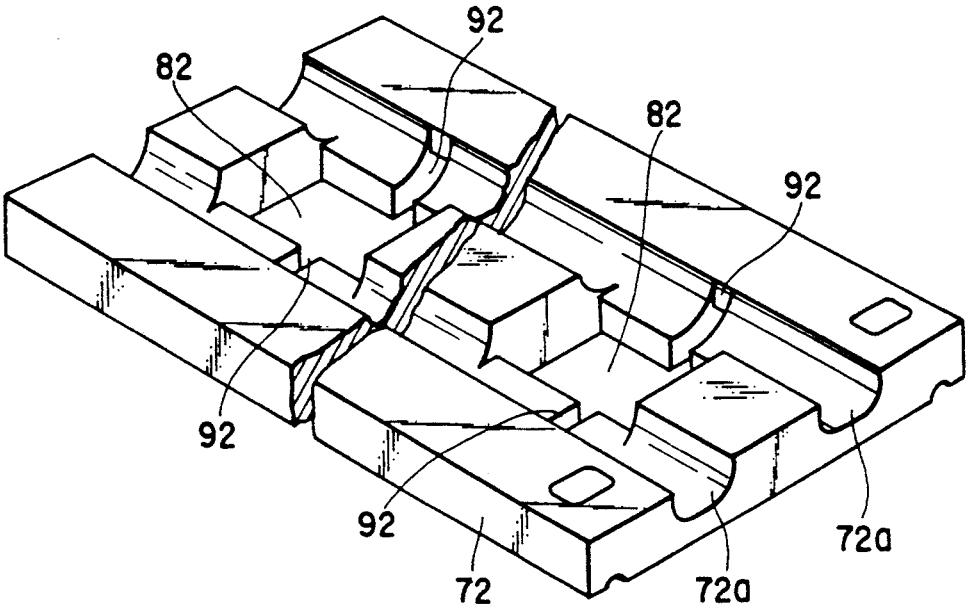
FIG. 5 is a perspective view of a vibration transmission plate according to the first embodiment.

A pair of guide rails 10 are provided in parallel along both end portions in the width direction of the upper surface of the base plate 2. Like the base plate 2, the guide rails 10 are formed of synthetic resin so as to have a cross section as shown in FIG. 4. Specifically, each guide rail 10 comprises a strip-shaped base portion 12, a pair of C-shaped engaging portions 14 provided at both ends in the width direction of the base portion 12 so as to face each other, and two pairs of L-shaped portions 18 respectively formed on the upper and lower surfaces of the middle portion in the width direction of the base portion 12. The end portions of the lower-side L-shaped portions 18 are formed integral.

Figure 14:
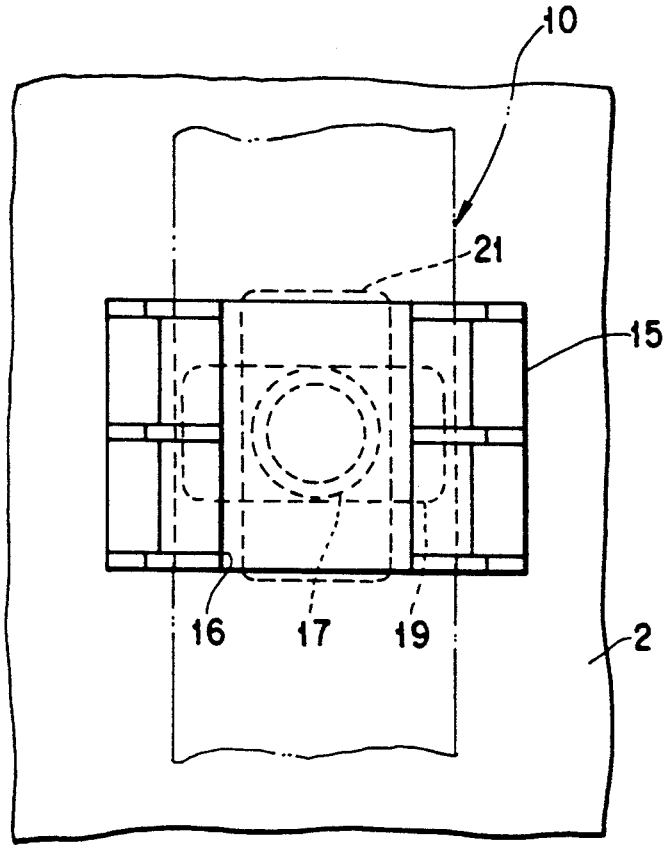
FIG. 14 is a plan view of a holder for holding the guide rail to the base plate.
Figure 15:
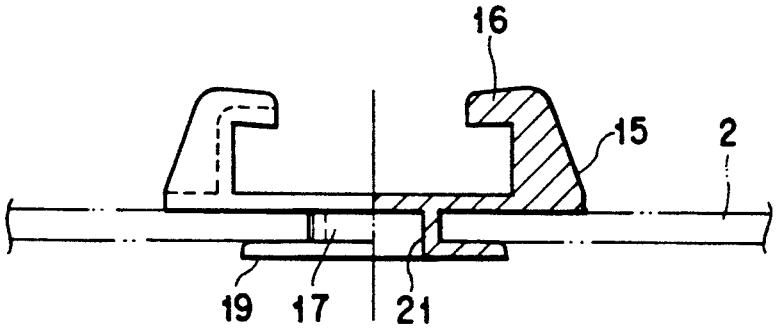
FIG. 15 is a side view of the holder shown in FIG. 14.

Each guide rail 10 is attached to the base plate 2 by a holder 15 shown in FIGS. 14 and 15. The holder 15 comprises a holder portion 16 having a channel-shaped cross section, a cylindrical coupling portion 17 situated below the holder portion 16, and a rectangular flange portion 19 coupled to the coupling portion 17. The holder portion 16, coupling portion 17 and flange portion 19 are formed of synthetic resin as one piece. The height of the coupling portion 17 is slightly less than the thickness of the base plate 2.

The base plate 2 has a rectangular opening 21 corresponding to the flange portion 19. The flange portion 19 is projected from the lower surface of the base plate 2 through the opening 21, and the holder 15 is then rotated 90°. Thus, the flange portion 19 is engaged with the lower surface of the base plate 2, and the holder 15 is attached to the base plate 2. The guide rail 10 is inserted in and held by the holder portion 16 of the holder 15, as indicated by broken lines in the figures.

As is shown FIG. 4 an upper passageway 20 is defined by one engaging portion 14 and one L-shaped portion 18 on the upper surface of one end portion in the width direction of the base portion 12, and similarly a lower passageway 22 is defined on the lower surface of the one end portion. A guide surface 24 for guiding a wheel (described later) is formed between the L-shaped portions 18 on the upper surface of the base portion 12.

Figure 8:
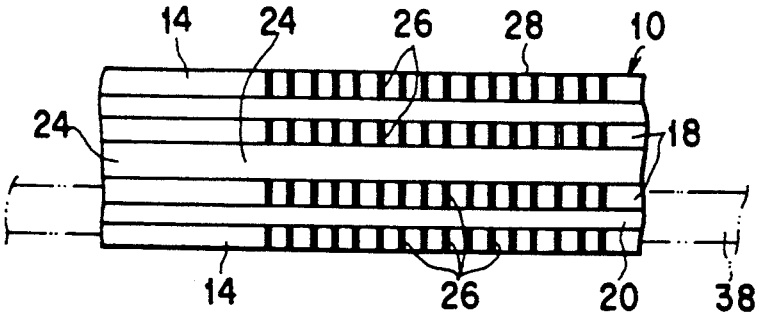
FIG. 8 is a plan view of part of a guide rail according to the first embodiment.
Figure 9:
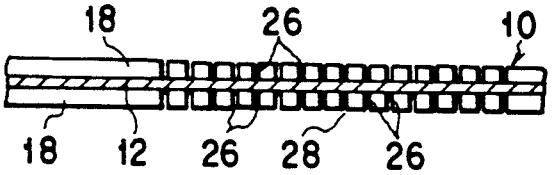
FIG. 9 is a cross-sectional view of part of the guide rail along its longitudinal axis, according to the first embodiment.

As is shown in FIGS. 8 and 9, the engaging portions 14 and the L-shaped portions of a longitudinal middle portion of the guide rail 10, i.e. the portion of the guide rail 10 corresponding to the first soft portion 8 of the base plate 2, are provided with slits 26. The slits 26 are formed at regular intervals along the longitudinal axis of rail 10 and extend over the entire width of the engaging portion 14 and L-shaped portion 18. Accordingly, the longitudinal middle portion of the guide rail 10 constitutes a second soft portion 28 which can be bent along with the first soft portion 8.

A longitudinal one end portion of the base plate 2 is provided with a driving unit 30, as shown in FIG. 1. The driving unit 30 has a casing 32. A driving source 33 in which a decelerator and a motor are integrated is provided within the casing 32. The driving source 33 rotates each of two pairs of gears 34 provided on both sides of the casing 32 in opposite directions. Each gear 34 is integrally provided with a drum 36.

As is shown in FIG. 3, both end portions of a belt 38 are wound around the paired drums 36 situated at one end of the casing 32. The belt 38 is passed through the upper and lower passageways 20 and 22 of the guide rail, and a middle portion of the belt 38 is passed over a pulley 40 rotatably supported at an end portion of the guide rail 10.

When the driving source 32 is driven and each pair of gears 34 are rotated in opposite directions, one end portion of the belt 38 is led out of the drum 36 of one gear 34, and the other end portion of the belt 38 is taken up by the drum 36 of the other gear 34. Thereby, the belt 38 is caused to run along the upper and lower passageways 20 and 22.

For example, in FIG. 3, when one drum 36 is rotated in the X-direction and the other drum 36 is rotated in the Y-direction, the portion of the belt 38 inserted in the upper passageway 20 is run in the Z-direction.

As is shown in FIG. 1, a pair of carriers 42 are provided between the pair of guide rails 10. Each carrier 42 has a hollow shaft 44 as shown in FIG. 4. Both end portions (only one shown) of the hollow shaft 44 are detachably fitted in engaging holes 48 in supports 46. A screw shaft 49 is inserted in the hollow shaft 44. Both end portions of the screw shaft 49, which are provided with male screws 50, are projected from the holes 48 and engaged with female screws 52.

Figure 10:
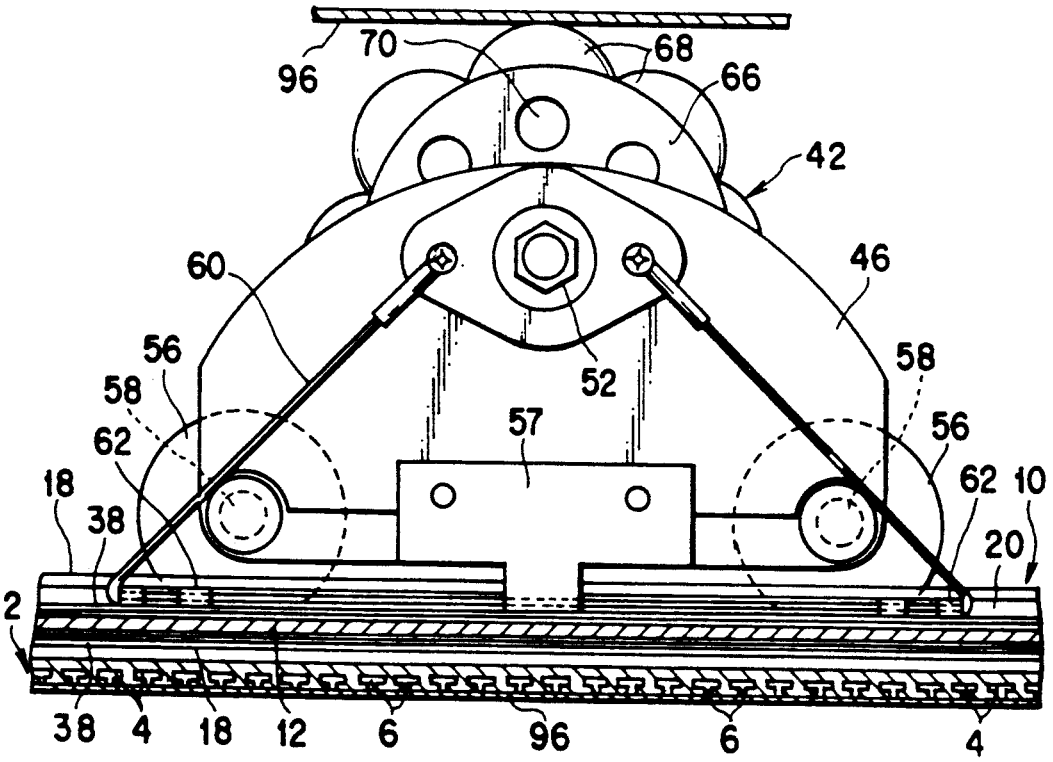
FIG. 10 is a side view of a support of the carrier according to the first embodiment.
Figure 11:
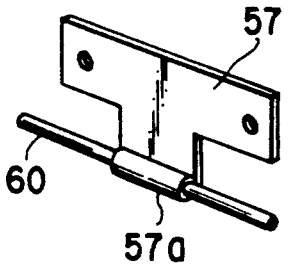
FIG. 11 is a perspective view of a guide member attached to the support according to the first embodiment.

As is shown in FIGS. 4 and 10, a pair of wheels 56 are rotatably supported by the supports 46 via support shafts 58. Each wheel 56 runs on the guide surface 24 of the guide rail 10. A T-shaped guide member 57, as shown in FIG. 11, is attached to a lower end of the support 46. A rolled portion 57*a* is formed at the lower end of the guide member 57. A middle portion of a wire 60 is slidably passed through the rolled portion 57*a*. Both end portions of the wire 60 are fixed to the upper part of the outer surface of the support 46.

A rod-shaped magnet 59 is provided on the inside surface of the support 46, as shown in FIG. 4. A pair of switches 61 (one switch shown) such as lead switches, which are operated when approaching the magnet 59, are provided on the upper surface at one end and the other end portions of the guide rail 10. When the switch 61 is operated, the direction of the carrier 42 driven by the driving source 33 is reversed. That is, the range of movement of the carrier 42 is limited by the magnet 59 and switches 61.

Figure 12:
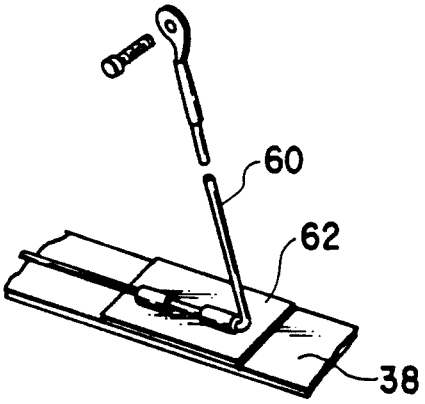
FIG. 12 is a perspective view of a coupling structure for the fixing plate and wire according to the first embodiment.
Figure 13:
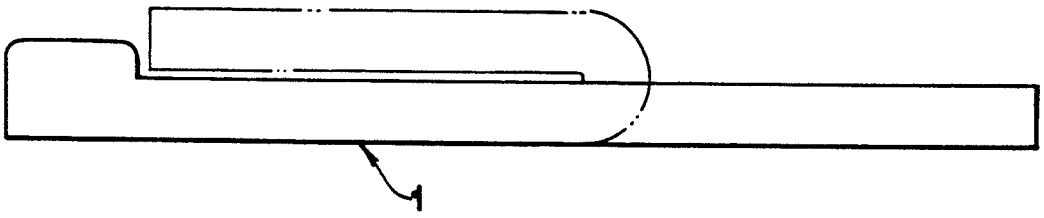
FIG. 13 is a side view of the massage apparatus according to the first embodiment.

As is shown in FIGS. 10 and 12, portions of the wire 60 on both sides of the rolled portion 57a are coupled to fixing plates 62 attached to the upper surface of the belt 38 passed through the upper passageway 20. Thus, the wire 60 is bent in a substantially triangular shape, with the fixing plates 62 as the bottom of the triangle. The carrier 42 can be moved along with the belt 38 by means of the fixing plates 62.

Four collars 64 (only two shown), as shown in FIG. 4, are provided on the hollow shaft 44 of the carrier 42 rotatably but axially unmovable. Massage rollers 66 are attached to the collars 64. The massage rollers 66 are formed of relatively hard elastic material such as rubber or synthetic resin. The outer peripheral surface of each roller 66 is provided with a number of semispherical projections 68 arranged at regular intervals. That part of each massage roller 66 which corresponds to each projection 68 is formed as a hollow portion 70, so that the projection 68 can easily be deformed in the radially inward direction.

As is shown in FIGS. 1 and 2, a pair of openings 71 functioning as fixing portions are formed between the guide rails 10 of the base plate 2. The width of the opening 71 is slightly less than the distance between a pair of massage rollers 66 supported at both axial end portions of the hollow shaft 44, and the two openings 71 are formed at the front and rear parts of the base plate 2 with the soft portion 8 interposed. Each opening 71 contains a rectangular vibration transmission plate 72 slightly smaller than the opening 71.

The vibration transmission plate 72 is formed of a material hard enough to transmit vibration and soft enough to give comfortable feeling to the user, e.g. foamed styrol, semihard foamed urethane, or foamed polyethylene. Man-made fiber cotton 73a and urethane foam 73b, which are elastic and serve as vibration absorbing material, are laminated below the vibration transmission plate 72. Specifically, the vibration transmission plate 71 is elastically deformable upward and downward, and downward vibration is absorbed by the man-made fiber cotton 73a and urethane foam 73b, as will be described later.

An end portion of a coupling band 74 of, e.g. knitted fabric is coupled to a peripheral portion of the vibration transmission plate 72. The other end portion of the coupling band 74 is fixed to the upper surface of the base plate 2 by a screw 73. The coupling band 74 can be bent. Accordingly, the vibration transmission plate 72 is supported within the opening 71 of the base plate 2 so as to be deformable vertically, without being displaced from a predetermined position within the opening 71.

A pair of running grooves 72a each having a semicircular cross section are formed at both axial end portions of the upper surface of the vibration transmission plate 72, such that each groove 72a extends over the entire longitudinal length of the vibration transmission plate 72. In the grooves 72a, a pair of inside massage rollers 66 supported by the hollow shaft 44 are situated. A pair of outside massage rollers 66 mounted on the hollow shaft 44 are situated apart from the end faces in the width direction of the vibration transmission plate 72. Thus, the distance between the upper surface of the vibration transmission plate 72 and the upper end of the massage rollers 66, i.e. the dimension G (in FIG. 4), can be decreased. Accordingly, as will be described later, the upper surface of the vibration transmission plate 72 can easily be put in contact with the body of the user, and the thickness of the entire apparatus can be reduced.

As is shown in FIGS. 1 and 2, a reinforcing plate 75 is fixed to the longitudinal middle part of the upper surface of the base plate 2, which corresponds to the first soft portion 8, that is, the part between the openings 71. A plurality of bending V-grooves 76 are formed in the reinforcing plate 75 at regular intervals along the longitudinal axis of the reinforcing plate 75, each groove 76 extending over the entire width of the plate 75. The bending grooves 76 of the reinforcing plate 75 constitute a third soft portion 78 which enables the reinforcing plate 75 to be bent along with the base plate 2. In addition, running grooves 75a of the same shape as the running grooves 72a are formed at that part of the bending grooves 76 which correspond to the running grooves 72a of the vibration transmission plate 72.

A plurality of containing portions 82 are formed at middle portions in the width direction of the vibration transmission plates 72, as shown in FIG. 2 (in this embodiment two container portions 82 in one vibration transmission plate, and three in the other vibration transmission plate) at regular intervals along the longitudinal axis of the plates 72.

Vibration generators 86 held by holding members 84 are contained in the container portions 82, as shown in FIG. 4. Each vibration generator 86 comprises a motor 86a and a weight 86c attached eccentrically to a rotary shaft 86b of the motor 86a. Vibration is caused by eccentric rotation of the weight 86c.

Each holding member 84 comprises a strip-shaped base plate 84a and a band 84b having an inverted U-shaped central portion. The vibration generator 86 is held between the base plate 84a and band 84b. Both end portions of the base plate 84a and 84b are fixed by screws 87 and adjoined to the lower surface of the vibration transmission plate 72, and are fixed to the vibration transmission plate 72 by a screw 88. The screw 88 is attached to a plate 89 adjoined to the bottom of the running groove 72a.

Figure 6:
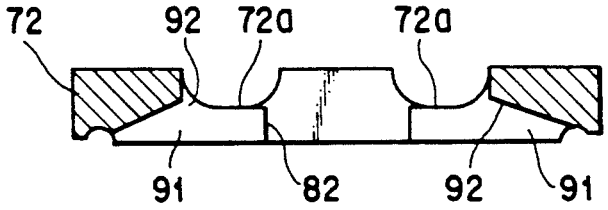
FIG. 6 is a cross-sectional view of the vibration transmission plate according to the first embodiment.

The lower surface of the vibration transmission plate 72 is provided with a communication groove 92 for communicating both end portions of the container portion 82 with a communication portion 91 opening to the lower surface and side surface of the vibration transmission plate 72, as shown in FIG. 6. Heat generated by the vibration generator 86 within the container portion 82 is dissipated to the outside from the communication portion 91 via the communication groove 92. Planar far-infrared heaters 93 are coupled to both side portions of the upper surface of the vibration transmission plate 72, except the central part in the width direction of the plate 72, as shown in FIG. 1.

On the other hand, a wall member 94 covering the outside portions of the guide rails 10 and one longitudinal end portion of the base plate 2 is provided on the upper surface of the base plate 2, as shown in FIG. 1. The wall member 94 is formed of elastic material such as foamed urethane.

The base plate 2 is covered with a bag-like cloth cover 96. The cover 96 is made of such material as nylon which does not easily absorb far infrared radiated from the far-infrared heaters 93. The user lies on his/her back over the cover 96 and is massaged by the massage rollers 66 supported by the carriers 42.

A control box 98 is provided within the casing 32 of the driving unit 30 of the base plate 2, as shown in FIG. 1. A remote controller 100 is connected to the control box 98. The remote controller 100 has switches 102 for remote-controlling the driving unit 30, vibration generators 86 and far-infrared heaters 93.

When the user is to be massaged by the massage apparatus having the above structure, the user lies on his/her back over the cover 96. In this state, the user operates the remote controller 100 and actuates the driving unit 30. When the driving unit 30 is actuated, the carriers 42 with the massage rollers 66 are reciprocally moved by the belts 38 along the guide rails 10. Thus, the back of the user can be massaged by the massage rollers 66.

When the user actuates the vibration generators 86 along with the driving unit 30, vibration generated by the vibration generators 86 is transmitted through the entire vibration transmission plates 72. That is, the vibration transmission plates 72 are vibrated. When the body of the user is put in contact with the vibration transmission plates 72 via the cover 96, the vibration of the vibration transmission plates 72 is transmitted to the user. Thus, the body of the user is massaged by vibration.

For example, when the paired carriers 42 are situated on one side of the base plate 2 (near the driving unit 30) as shown in FIG. 1, and the head of the user is situated on the same side of the base plate 2, the part of the user lower than the waist (i.e. except the head and the upper part of the back of the user) is put on the vibration plate 72 via the cover 96. Thus, the upper part of the back of the user is massaged by the massage rollers 66 of the carriers 42 and simultaneously the part of the user lower than the waist is massaged by the vibration transmission plate 72.

When the carriers 42 are moved from the aforementioned one side of the base plate 2 to the other side, the upper part of the back of the user is gradually put in contact with the vibration transmission plate 72 and massaged, inversely, and the part lower than the waist is massaged by the massage rollers 66.

As stated above, part of the user's body is massaged by the massage rollers 66 and other part is massaged by the vibration transmission plate 72. Thus, even if the running speed of the massage rollers 66 is decreased so as to prevent the user from feeling a pain, the massage effects can be sufficiently enhanced by the vibration transmission plate 72.

The vibration transmission plates 72 which hold the vibration generators 86 can be displaced relative to the base plate 2. That is, even if the vibration transmission plates 72 are vibrated along with the vibration generators 86, the vibration of the vibration transmission plates 72 is not transmitted to the base plate 2. Thus, the carriers 42 mounted on the base plate 2 and the driving unit 30 and belts 38 for driving the carriers 42 are hardly vibrated. Accordingly, these members are not damaged by vibration, and unstable running of the carriers 42 can be prevented.

When the far-infrared heaters 92 are powered by the remote controller 100, far infrared is radiated. Far infrared radiation has a rectilinear propagation property, and the cover 96 on which the user lies is made of a material permeable to far infrared. Thus, far infrared can be efficiently radiated on the user. The far infrared is easily absorbed in the human body through the skin of the body, and warms the inside of the body. The user can be massaged while his/her body is warmed. Thus, the massage effects can be further enhanced.

The vibration transmission plate 72 has the running grooves **72*a* through which the inner pair of massage rollers 66 of the carriers 42 are passed, and the outer pair of massage rollers 66 are situated outside the side faces in the width direction of the vibration transmission plates 72. The height of the massage apparatus 1 can be reduced by a degree by which the inner pair of massage rollers 66 are placed in the running grooves 72*a***.

Since the distance G between the upper surface of the vibration transmission plates 72 and the upper end portions of the massage rollers 66 is reduced, the user's body can easily put in contact with the upper surface of the vibration transmission plates 72. Thus, while the back of the body is supported by the vibration transmission plate 72, the body can be massaged by the massage rollers 66 and the massage effects by the vibration transmission plate 72 can be enhanced. In addition, since the back of the body is received by the upper surface of the vibration transmission plate 72, the body is not strongly put in contact with the massage rollers 66. Thus, the user can be massaged while he/she does not feel a pain.

In addition, the user can be massaged by only the massage rollers 66 or only the vibration generators 86. When the user is to be massaged by only the vibration vibrators 86, the massage rollers 66 are moved to one end of the base plate 2. In this case, only some of the vibration generators 86, which correspond to the part of the user's body to be massaged, may be driven, or the vibration generators 86 may be successively driven along the longitudinal axis of the base plate 2 so that the part to be massaged by vibration can be shifted. In this case, a switch 102 for these operations is provided on the remove controller 100.

On the other hand, the massage apparatus 1 can be folded from the use state (indicated by a solid line in FIG. 13) to the non-use state (a broken line). Thus, the massage apparatus is convenient for storage or carrying.

In the above embodiment, the massage apparatus has two carriers with massage rollers; however, the number of carriers may be one.

The far-infrared heaters of the vibration transmission plates may be replaced by regular sheet-shaped heaters.

Figure 16:
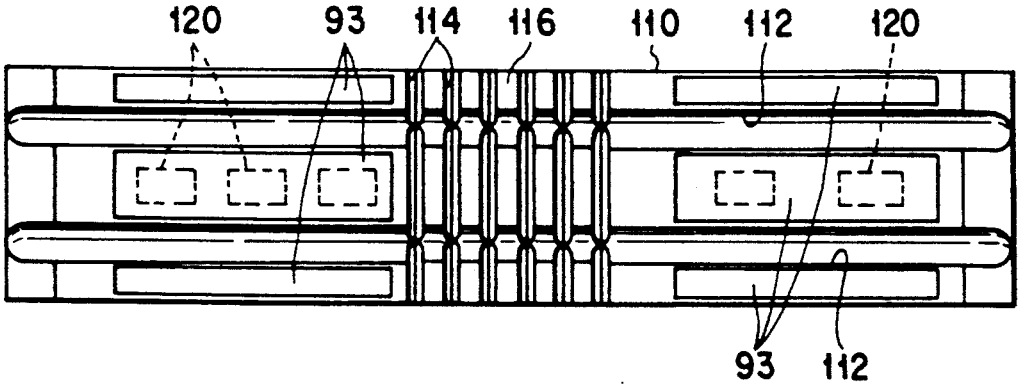
FIG. 16 is a plan view of a vibration transmission plate according to a second embodiment of the invention.
Figure 17:
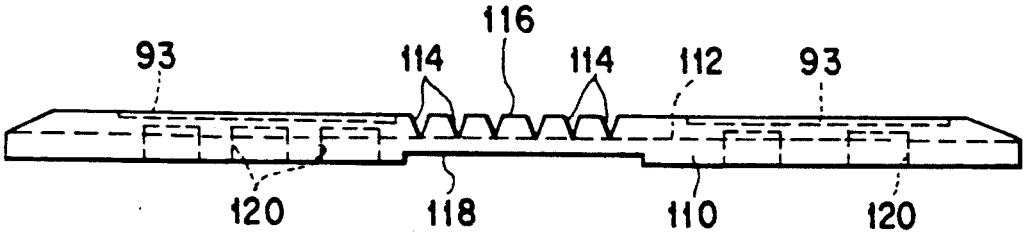
FIG. 17 is a side view of the vibration transmission plate according to the second embodiment.
Figure 18:
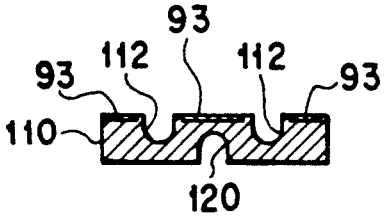
FIG. 18 is a cross-sectional view of the vibration transmission plate according to the second embodiment.

FIGS. 16 to 18 show a second embodiment of the invention which differs from the first embodiment with respect to the structure of a vibration transmission plate 110. Specifically, the length of the vibration transmission plate 110 is equal to the total length of the paired vibration transmission plates 72 and reinforcing plate 75 in the first embodiment. A pair of running grooves 112, through which the massage rollers 66 are passed, are formed over almost the entire longitudinal length of the upper surface of the vibration transmission plate 110 at both end portions in the width direction of the plate 110. Bending grooves 114 each having a V-cross section are formed at regular intervals in the longitudinal middle part of the vibration transmission plate 110 which corresponds to the first soft portion 8 of the base plate 2. The bending grooves 114 constitute a third soft portion 116 which enables the vibration transmission plate 110 to be folded along with the base plate 2.

A recess 118 is formed in that part of the lower surface of the vibration transmission plate 110, which corresponds to the third soft portion 116, thereby making thinner this part of the lower surface of the plate 110.

By virtue of the recess 118, the vibration transmission plate 110 can easily be bent.

A middle part in the width direction of the vibration transmission plate 110 is provided with containing portions 120 each having a semicircular cross section and opening to the lower surface of the plate 110. The containing portions 120 are arranged at regular intervals along the longitudinal axis of the plate 110. Each container portion 120 contains the vibration generator 86 held by the holding member 84, as in the first embodiment. Far-infrared heaters 93 are provided at both end portions and middle portions in the width direction of the vibration transmission plate 110.

Like the first embodiment, the vibration transmission plate 110 may be stored in the opening 71 formed in the base plate 2, or attached to the upper surface of the base plate 2. In this case, an elastic material for absorbing vibration may be interposed between the upper surface of the base plate 2 and the lower surface of the vibration transmission plate 110.

Figure 19:
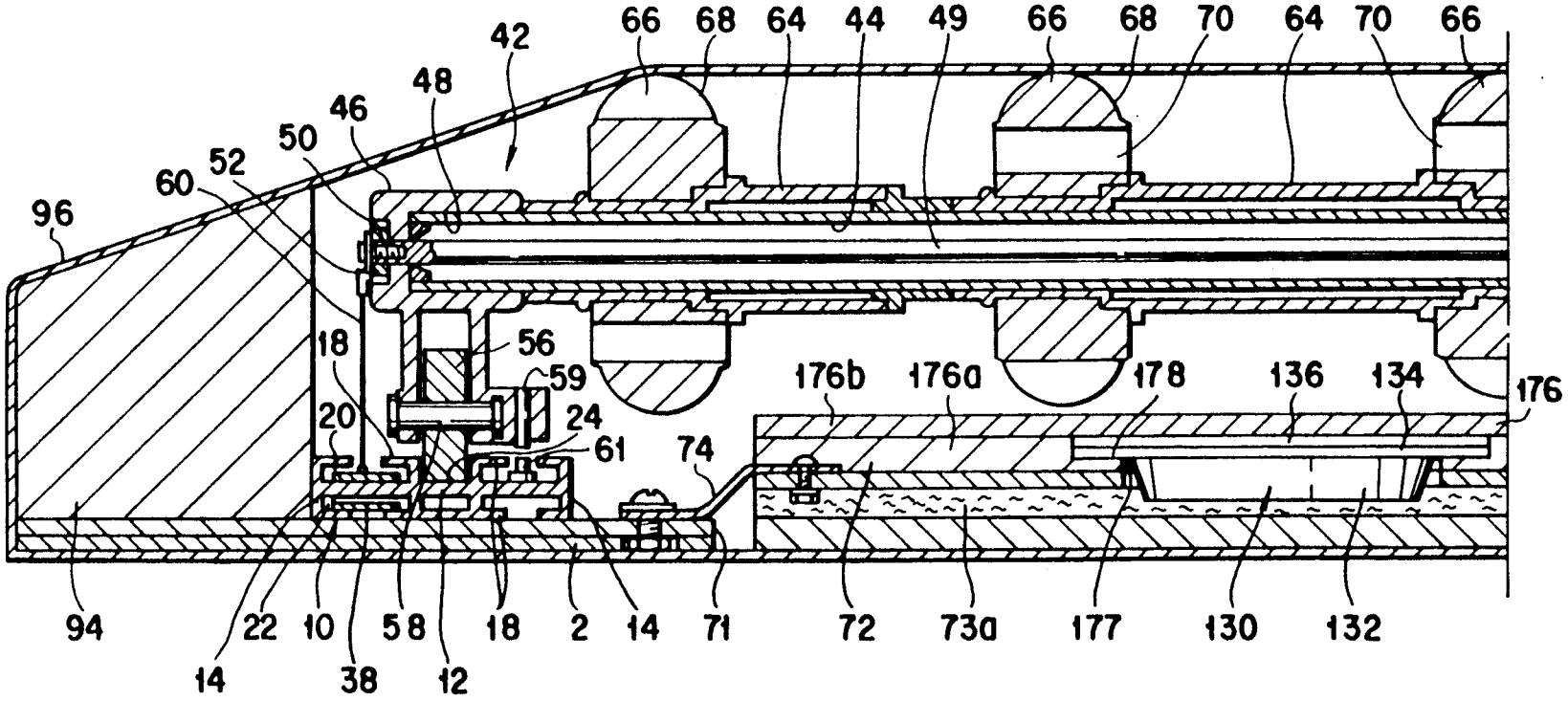
FIG. 19 is a partly enlarged cross-sectional view of a carrier according to a third embodiment.
Figure 20:
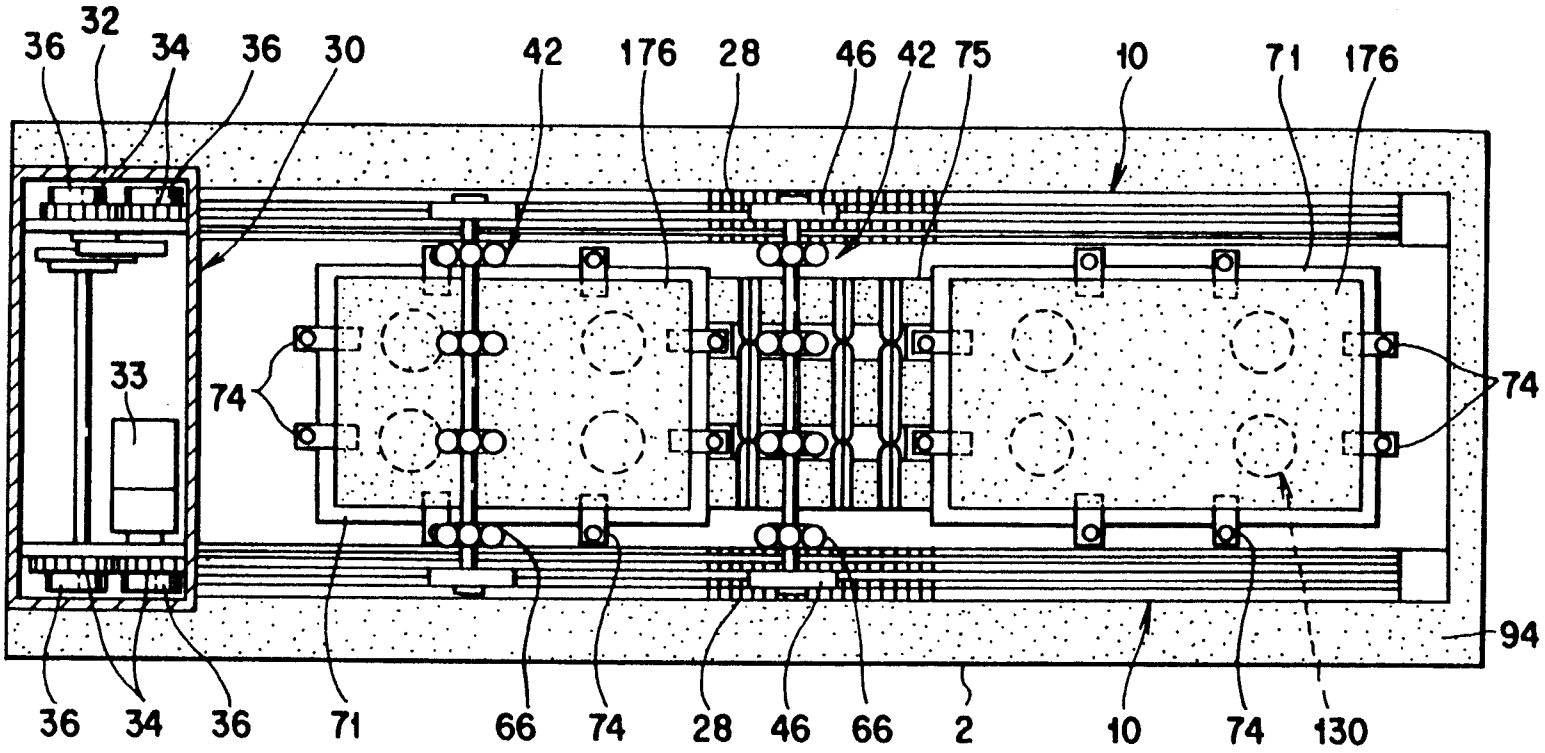
FIG. 20 is a plan view of the base plate according to the third embodiment.
Figure 21:
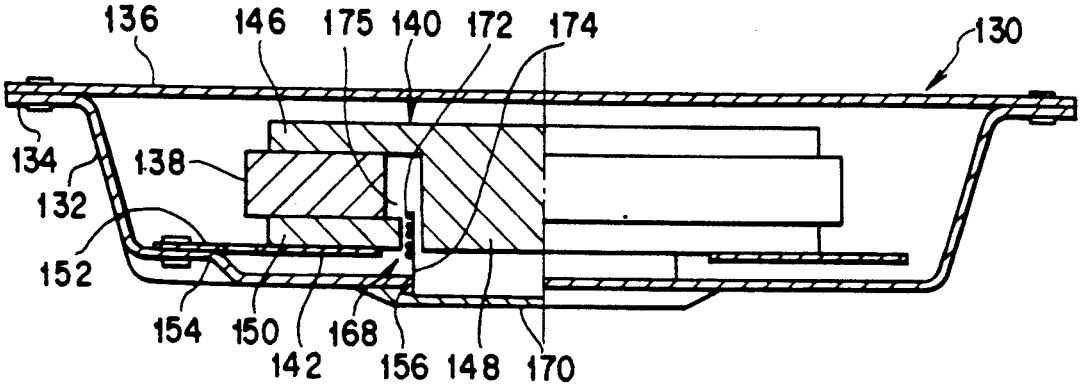
FIG. 21 is a cross-sectional view of a vibration generator according to the third embodiment.

FIGS. 19 to 21 show a third embodiment of the invention which differs from the first embodiment with respect to the structure of the vibration generator. Specifically, a vibration generator 130 according to the third embodiment has a dish-shaped casing 132 having an opened top portion, as shown in FIG. 21. A flange 134 is formed at an opened edge of the casing 132, and a peripheral portion of a cover 136 for closing the opening of the casing 132 is fixed to the flange 134.

Within the casing 132, a yoke 140 with an annular magnet 138 is elastically held by a damper 142. The yoke 140 is constituted by a pole piece 148 provided with a bottom plate 146 at a peripheral portion on one side of the pole piece 148, and an annular yoke plate 150. A peripheral portion of the damper 142 is provided with four projections 152 (only one shown in FIG. 21) projecting radially outwards. The projections 152 are fixed to fixing portions 154 formed on inner bottom portions of the casing 132.

The bottom of the casing 132 is provided with an opening 156 in which a voice coil 168 is provided. The voice coil 168 is constituted by a fixing plate 170 closing the opening 156, and a bobbin 174 standing on the inner face of the fixing plate 170. A coil 172 is wound around the periphery of the bobbin 174. The bobbin 174 is situated in a space 175 defined by the outer periphery of the pole piece 148 of the yoke 140 and the inner peripheries of the yoke plate 150 and magnet 138.

When a so-called low-band electric signal of 150 Hz or less is delivered to the coil 172 from an audio apparatus such as a radio or a tape recorder, the yoke 144 and casing 132 are displaced relative to each other, while the damper 142 is deformed elastically, by magnetic interference between magnetic force of the coil 172 and that of the magnet 138. Thus, the casing 132 is vibrated.

As is shown in FIG. 19, the vibration generator 130 having the above structure is mounted on a vibration transmission plate 176. The vibration transmission plate 176 comprises a lower plate **176*a* and an upper plate 176*b*, and a through-hole 177 is formed in the lower plate 176*a*. A peripheral portion of the through-hole 177 is provided with a stepped portion 178. The flange 134 of the casing 132 is engaged with the stepped portion 178. Thereby, the vibration generator 130 is integrally held by the vibration transmission plate 176. The cover 136 is fixed on the lower surface of the upper plate 176*b*. The vibration transmission plate 176 is thinner than the vibration transmission plate 72 of the first embodiment and is not provided with the running grooves 72*a* for massage rollers 66 or the container portions 82. A single vibration transmission plate 176 is provided with four vibration generators 130, as shown in FIG. 20**.

Regarding the third embodiment, the structural parts common to the first embodiment are denoted by like reference numerals and a description thereof is omitted.

Figure 22:
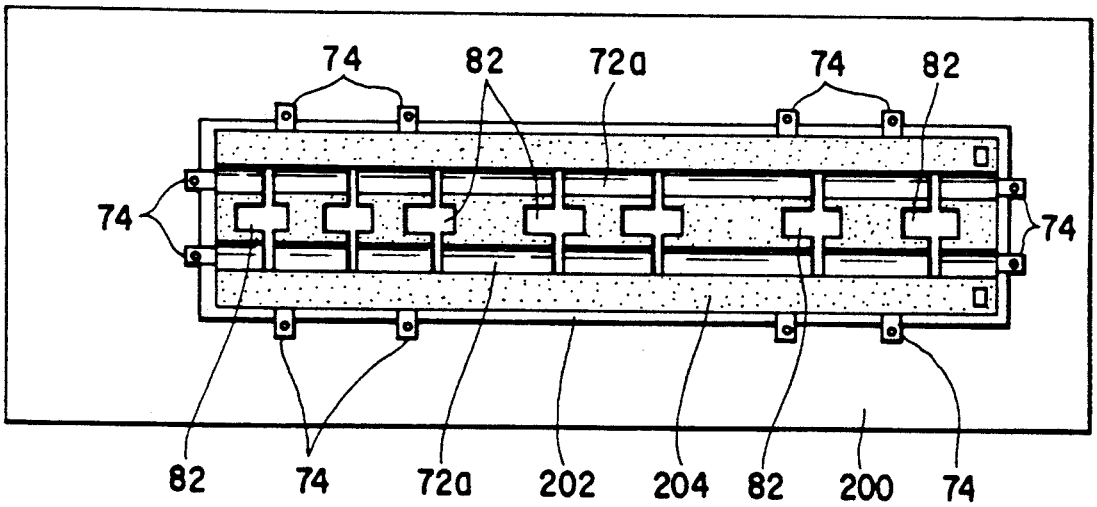
FIG. 22 is a plan view of a base plate provided with a vibration transmission plate according to a fourth embodiment of the invention.

FIG. 22 shows a fourth embodiment of the invention. In the fourth embodiment, a base plate 200 cannot be folded. Specifically, the base plate 200 is not provided with the first soft portion 8, unlike the first embodiment.

The base plate 200 has an opening 202 extending over almost the entire length of the base plate 200. A single vibration transmission plate 204 is contained in the opening 202. The vibration transmission plate 204 is coupled to the base plate 200 by coupling bands 74 so as to be vertically movable. Like the first embodiment, a pair of running grooves **72*a* through which massage rollers 66 are passed are formed at both end portions in the width direction of the vibration transmission plate 204 over the entire length of the plate 204. Containing portions 82 for containing motor-type vibration generators 86 as employed in the first embodiment are formed in the middle part in the width direction of the vibration transmission plate 204 at regular intervals along the longitudinal axis of the plate 204**.

Since the base plate 200 cannot be folded, the vibration generators 86 can be provided at the longitudinal middle part of the base plate 200. In other words, the number of vibration generators 86 capable of being provided on the vibration transmission plate 204 can be increased.

Regarding the fourth embodiment, the structural parts common to the first embodiment are denoted by like reference numerals and a description thereof is omitted.

Figure 23:
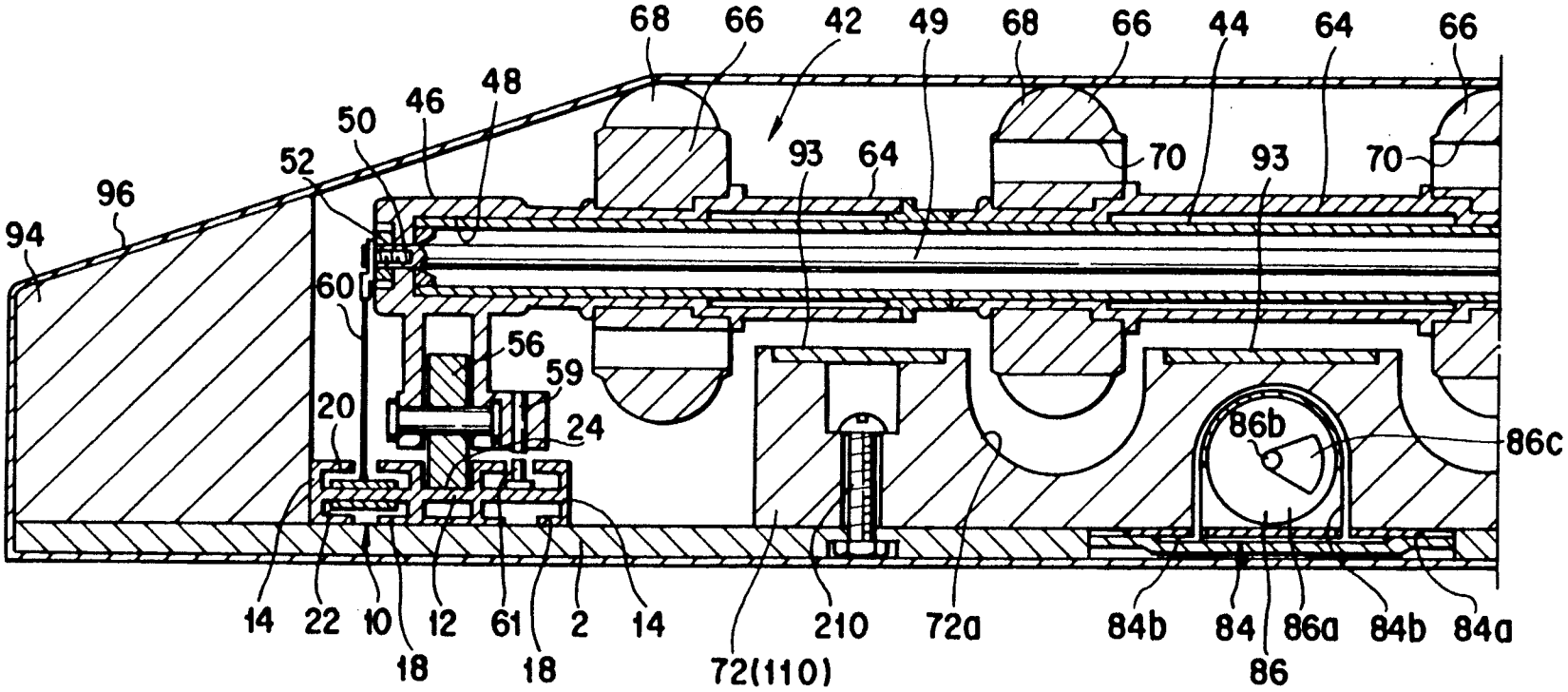
FIG. 23 is an enlarged cross-sectional view of a fixing structure of a vibration transmission plate according to a fifth embodiment of the invention.

FIG. 23 shows a fifth embodiment of the invention. The fifth embodiment is directed to a modification of the fixing structure of the vibration transmission plate 72 of the first embodiment or the vibration transmission plate 110 of the second embodiment. Specifically, the vibration transmission plate 72 or 110 is coupled to the upper surface of the base plate 2 and fixed by screws 210.

In this structure, when the vibration generators 84 are driven, the vibration transmission plate 72 or 110 vibrates, and, like each of the above embodiments, the user can be massaged.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A massage apparatus on which a user is adapted to lie, comprising:

a flat and long base plate;

a carrier holding massage rollers located over an upper surface of the long base plate and movable in the longitudinal direction of the long base plate;

driving means coupled to the carrier for reciprocally driving the carrier in the longitudinal direction of the base plate;

a vibration transmission plate made of a material capable of transmitting vibration;

coupling means for coupling the vibration transmission plate to the base plate such that the vibration transmission plate is movable relative to the base plate independently of the massage rollers;

a vibration generator coupled to the vibration transmission plate and driven to vibrate the vibration transmission plate so as to move the vibration transmission plate relative to the base plate;

said vibration transmission plate having a hollow container portion therein, and wherein the vibration generator is held in the hollow container portion;

the vibration of the vibration transmission plate being carried out separately and independently of movement of the massage rollers; and a cover covering at least an upper surface of the base plate and covering the vibration transmission plate, the carrier and the massage rollers, whereby massage imparted by vibration of the vibration transmission plate and massage imparted by movement of the massage rollers are both applied independently and at the same time to a user who is lying down on the cover.

2. An apparatus according to claim 1, further comprising:

a fixing portion on the base plate, said coupling means coupling said vibration transmission plate to the fixing portion such that the vibration transmission plate is at least vertically vibrationally movable relative to the base plate.

3. An apparatus according to claim 2, wherein the fixing portion comprises an opening in the base plate.

4. An apparatus according to claim 1, further comprising support means, on the lower side of the vibration transmission plate, for elastically and movably supporting the vibration transmission plate relative to the base plate so as to allow said vertical vibrational movement of the vibration transmission plate relative to the base plate.

5. An apparatus according to claim 4, wherein the support means comprises an elastic material.

6. A massage apparatus on which a user is adapted to lie, comprising:

a flat and long base plate;

a carrier holding massage rollers located over an upper surface of the long base plate and movable in the longitudinal direction of the long base plate;

driving means coupled to the carrier for reciprocally driving the carrier in the longitudinal direction of the base plate;

a vibration transmission plate made of a material capable of transmitting vibration;

coupling means for coupling the vibration transmission plate to the base plate such that the vibration transmission plate is movable relative to the base plate independently of the massage rollers;

a running groove, formed in an upper surface of the vibration transmission plate, and through which radially outward portions of the massage rollers are passed, the running groove extending in a direction in which the massage rollers run;

a vibration generator coupled to the vibration transmission plate and driven to vibrate the vibration transmission plate so as to move the vibration transmission plate relative to the base plate;

the vibration of the vibration transmission plate being carried out separately and independently of movement of the massage rollers; and a cover covering at least an upper surface of the base plate and covering the vibration transmission plate, the carrier and the massage rollers, whereby massage imparted by vibration of the vibration transmission plate and massage imparted by movement of the massage rollers are both applied independently and at the same time to a user who is lying down on the cover.

7. An apparatus according to claim 6, wherein the direction in which the running groove extends is the longitudinal direction of the base plate.

8. An apparatus according to claim 1, wherein the vibration generator comprises a motor and a weight rotated eccentrically by the motor.

9. An apparatus according to claim 1, wherein the vibration generator comprises:

a casing;

a coil in the casing and receiving an electric signal of a predetermined frequency to generate a magnetic force; and a yoke which is vibratable relative to the casing by the magnetic force generated by the coil.

10. An apparatus according to claim 1, wherein the base plate is foldable at least at a longitudinal middle portion of the base plate.

11. An apparatus according to claim 1, wherein the vibration transmission plate comprises a communication groove therein for permitting heat generated by the vibration generator in the hollow container portion to escape outside of the apparatus.

12. An apparatus according to claim 11, wherein said communication groove opens into the hollow container portion.

13. A massage apparatus on which a user is adapted to lie, comprising:

a flat and long base plate;

a carrier holding massage rollers located over an upper surface of the long base plate and movable in the longitudinal direction of the long base plate;

driving means coupled to the carrier for reciprocally driving the carrier in the longitudinal direction of the base plate;

a vibration transmission plate made of a material capable of transmitting vibration;

coupling means for coupling the vibration transmission plate to the base plate such that the vibration transmission plate is movable relative to the base plate independently of the massage rollers;

a vibration generator coupled to the vibration transmission plate and driven to vibrate the vibration transmission plate so as to move the vibration transmission plate relative to the base plate;

the vibration of the vibration transmission plate being carried out and separately and independently of movement of the massage rollers;

a heater mounted to an upper surface of the vibration transmission plate; and a cover covering at least an upper surface of the base plate and covering the vibration transmission plate, the carrier and the massage rollers, whereby massage imparted by vibration of the vibration transmission plate and massage imparted by movement of the massage rollers are both applied independently and at the same time to a user who is lying down on the cover.

14. An apparatus according to claim 13, wherein the heater is a planar heater.

15. An apparatus according to claim 13, further comprising a pair of said heaters mounted to side portions of the upper surface of the vibration transmission plate.

16. An apparatus according to claim 15, wherein the heaters are planar heaters.

* * * * *